United States Patent [19]

Barber

[11] Patent Number: 4,971,314

[45] Date of Patent: Nov. 20, 1990

[54] ROTATING DISC AMUSEMENT RIDE

[76] Inventor: Jerry L. Barber, 10 Whittington Ct., Greenville, S.C. 29615

[21] Appl. No.: 356,870

[22] Filed: Aug. 25, 1989

[51] Int. Cl.[5] ..... A63G 3/00

[52] U.S. Cl. ..... 272/35; 104/69; 104/86; 272/48

[58] Field of Search ..... 272/32, 35; 104/58, 104/59, 69, 70, 73, 86

[56] References Cited

U.S. PATENT DOCUMENTS

| | | | |
|---|---|---|---|
| 1,279,911 | 9/1918 | Ridgway | 272/35 |
| 1,577,689 | 3/1926 | Capitelli | 272/35 |
| 1,738,355 | 12/1929 | Cappabianco | 272/35 |
| 1,877,256 | 9/1932 | Siebert . | |
| 2,458,150 | 1/1949 | D'Errico . | |
| 2,806,697 | 9/1957 | Huhn et al. | 272/35 |
| 3,987,581 | 10/1976 | Brown . | |
| 4,193,470 | 3/1980 | Logan . | |
| 4,821,647 | 4/1989 | Powell et al. | 104/69 X |
| 4,836,521 | 6/1989 | Barber | 272/32 |

*Primary Examiner*—Richard E. Chilcot, Jr.
*Attorney, Agent, or Firm*—Dority & Manning

[57] ABSTRACT

The subject matter of the disclosure is an amusement ride system having one or more passenger-carrying cars adapted for movement on an air flotation, rotating platform arranged at an angle to the horizontal plane. The cars are brought to the top side of the angled platform and allowed to free fall under gravity to the lower side of the platform. As the cars so descend, they bump into other cars and railings so that they experience random movement and rotation. Another embodiment utilizes roller ball devices instead of air flotation for providing free wheeling, random motion to the cars.

22 Claims, 6 Drawing Sheets

ROTATING DISC AMUSEMENT RIDE

BACKGROUND OF THE INVENTION

The present invention relates to an amusement ride system and, more particularly, to an amusement ride employing non-driven moving cars containing one or more people adapted for bumping into each other and railings arranged in the system.

There are many varieties of amusement ride systems employing a plurality of bumping vehicles or cars containing one or more passengers for random travel within a restricted area. More prevalent in this type of amusement ride are those systems employing cars which bump each other and railings or bumper elements positioned within the restricted area. In some of these systems, a passenger in the vehicle is allowed to control, to some extent, his movement and orientation relative to the other cars and the area of movement. In still other systems, the vehicles are allowed to be moved in a passive sense either by external sources of a force, or by striking of other cars without control by the operator.

In those systems which permit the operator some limited control over the direction of movement and orientation of a vehicle, it has been observed that in many instances, some of the cars, at least those having passengers which are rather timid and not aggressive with respect to causing bumping engagements with vehicles, tend to congregate in some corner or some other position on a riding platform where activity is at a minimum, or in some instances, are held in park positions either by inability to control his vehicle or by the bunching up of other vehicles. In many of these instances, the affected passenger is intimidated by the more aggressive operators of the other vehicles and, upon conclusion of the amusement ride, is rather disappointed if not completely unhappy because of the predicament he experienced.

In some of the conventional amusement rides of the type described above, ground effect or air flotation principles and mechanisms therefore are utilized to permit the easy movement of amusement vehicles upon a platform. In these systems, the platform is provided with a plurality of openings, and fluidized pressure is introduced below the platform for directing air through the openings. The individual vehicles or cars are designed with suitably formed cavities which, upon experiencing the movement of the air through the openings, is lifted or nearly so relative to the platform.

In any event, the frictional engagement of the vehicles and the platform surface is substantially reduced so that the individual cars may be easily moved about randomly upon the platform. This arrangement provides great amusement for the passengers in the vehicles since slight bumping of one vehicle relative to another or to a railing surrounding the riding platform causes immediate change in directions and orientation of the vehicles and perhaps even various degrees of rotational speed imparted thereto.

An example of such a system in a prior art is disclosed in U.S. Pat. No. 4,193,470. In this patent, an amusement ride system is disclosed having a horizontally arranged platform for vehicles which are adapted to provide control by the passengers for movement of the vehicles around the platform. The disadvantage in this system is that more timid passengers are likely to be intimidated by the more aggressive passengers in other vehicles and be pushed or bumped around and/or be held in a corner or in passive activity throughout the entire ride. Another example of an air flotation device for moving objects is disclosed in U.S. Pat. No. 3,987,581. However, there is no means for effecting random movement of vehicles, which thereby lessens the pleasure in riding in such vehicles. In U.S. Pat. Nos. 1,877,256 and 2,458,150, there is disclosed amusement rides employing a platform for vehicles arranged at a slight acute angle relative to a horizontal plane. This arrangement adds to the effect of gravity to the cars by driving the same around fixed tracks arranged on a platform. In these arrangements, there is no provision for bumper car activity which is a specific form of pleasure for participants at amusement parks.

The present invention has been devised to overcome the disadvantages and problems discussed above by providing for bumper car amusement that is available equally for all types of personalities of those who engage in this type of amusement. In the present invention, the passengers have absolutely no control over the vehicle or car in which they are riding and yet the cars are capable of random bumping action equally applicable to all of the cars regardless of the number and status of experience of the passengers.

Therefore, it is the principle object of the present invention to enhance the amusement capability of bumper car amusement rides by producing random motion of passenger cars equally applicable to all cars without passenger control.

Another object of the invention is to increase the amusement of bumper car amusement arrangements by handling all of the cars in the system equally so that all passengers in all the vehicles derive the same motions capable for the system.

SUMMARY OF THE INVENTION

In the preferred embodiment, the present invention includes a riding platform for vehicles arranged in a plane at an angle preferably at 22° relative to the horizontal plane. An air flotation system is incorporated with the platform which is formed with a plurality of openings to provide air flotation of the vehicles on the platform. The air pressure sizes of the openings and dispersing thereof are such as to reduce the frictional engagement of the cars and the surface of the platform so as to permit random movement of the cars upon the surface during rotation of the platform. The platform is rotated at a predetermined speed and is surrounded by a railing against which the cars are allowed to bump and to be spun along their axes by the combined effect of vertical movement in either direction and rotation thereof. As the platform is rotated, the cars are brought to the top side of the platform and allowed to move by gravity downwardly to the low side of the platform thereby being bumped therealong by other cars, so that directional movement of the vehicles in the descent may be diverted in either direction and be rotated randomly.

In another embodiment of the present invention, a fixed car-riding platform is utilized in conjunction with air flotation. In this arrangement, the platform is mounted at an angle relative to the horizontal plane, and the holes in the platform become smaller and/or less frequent to effect slowing down and stopping of cars at the bottom area of the platform.

These and other advantages of the present invention will become apparent after reading the following description taken in conjunction with the drawings wherein FIG. 1 is an isometric view of the amusement ride system device in accordance with a preferred embodiment of the present invention utilizing air flotation principles;

DESCRIPTION OF THE PREFERRED EMBODIMENT

Figure 1:
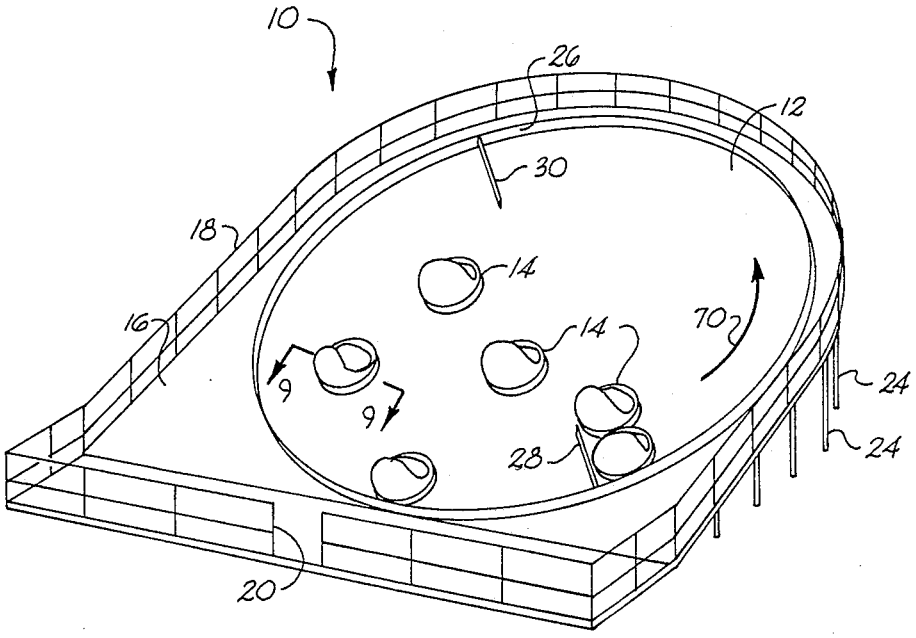

In FIG. 1 of the drawings, the amusement ride system device in accordance with the present invention is indicated generally by the reference numeral 10. The system 10 comprises an operating platform 12 upon which a plurality of passenger-carrying vehicles or cars 14 are allowed to ride in random fashion, a walking deck 16 for the use of passengers to board or exit the cars and a fence 18 surrounding the system for the safety of the passengers. A suitable gate 20 in the fence 18 allows passengers and the operators to enter the system or exit therefrom.

Figure 2:
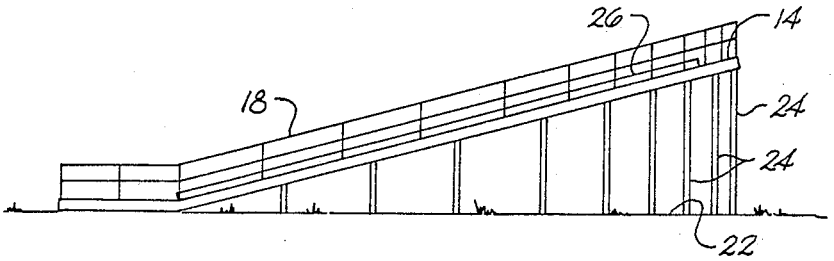
FIG. 2 is an elevational view of the amusement drive system.

As shown in FIG. 2, the plane of the platform 12 is at an angle relative to the horizontal plane herein represented by ground level and indicated by the reference numeral 22. Preferably, the angle between the plane for the platform 12 and the horizontal plane 22 is approximately 22°, however, it will be understood that any other angle which is capable of effecting the riding or amusement characteristics of the system 10 as described below may be utilized. The walking deck 16 within which the operating platform 12 is arranged to be supported and operated is suitably mounted upon the ground 22 by pillars 24.

The operating platform 12 is surrounded by a railing 26 which serves to contain the vehicles 14 within the confines of the platform 12 and against which the cars are adapted to be bumped. By virtue of this bumping action, the cars are propelled in random directions of movement as well as caused to spin in any direction, both movements being dependent upon the angle of bumping and intensity thereof. While the railing 26 is shown in FIG. 3 as being secured to the platform 12 so as to move therewith, the railing may be secured to the adjacent circular edge of the walking deck 16, as will be described below.

Extending radially inwardly from the railing 26 is at least one short expanse of a railing 28 secured to the platform and movable rotatably therewith. Another short expanse of railing 30 secured to the platform and positioned diametrically opposed to the railing 28 may be added to the system to add to the randomness of a car's movement. The railings 28, 30 serve to bring one or more cars upwardly from the lower side of the platform toward the higher side so that these cars may be able to drift downwardly under gravity for random motion and bumping action as the cars proceed downwardly to the lower side of the platform, as will be described hereinafter.

Figure 3:
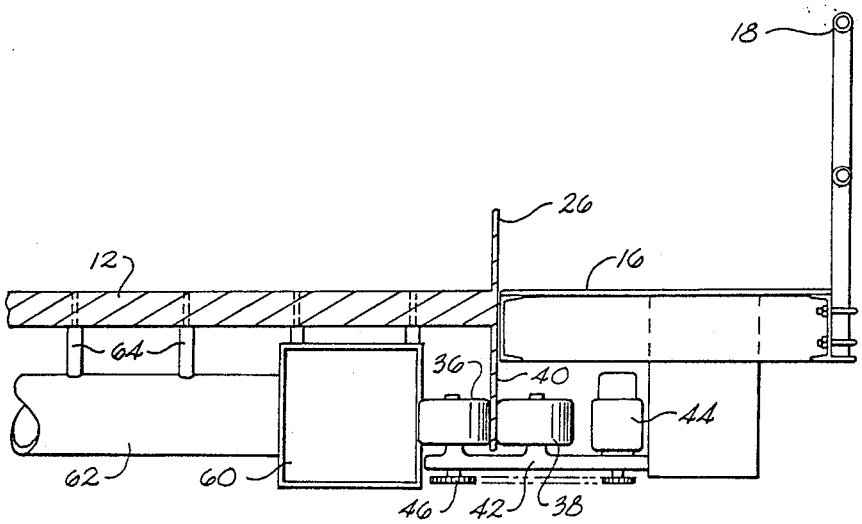
FIG. 3 is a partial cross-section of one side of the platform showing the drive system therefor.

Rotational movement is imparted to the platform 12 by a drive mechanism illustrated in FIG. 3 comprising a motor drive system generally indicated by the reference numeral 34. The drive system comprises a pair of opposing drive rollers 36, 38 arranged with their rotating axes in parallel and each being engageable with one side of a rim 40 depending from the circumferential edge of the platform 12. The rollers 36, 38 are preferably made from high friction materials such as rubber and are arranged for rotation upon a base 42 which also supports a motor 44 connected to the rollers by a gear mechanism 46. Suitable controls (not shown) associated with the motor 44 may be utilized by the operator of the system 10 for controlling the rotational speed of the platform 12.

Figure 6:
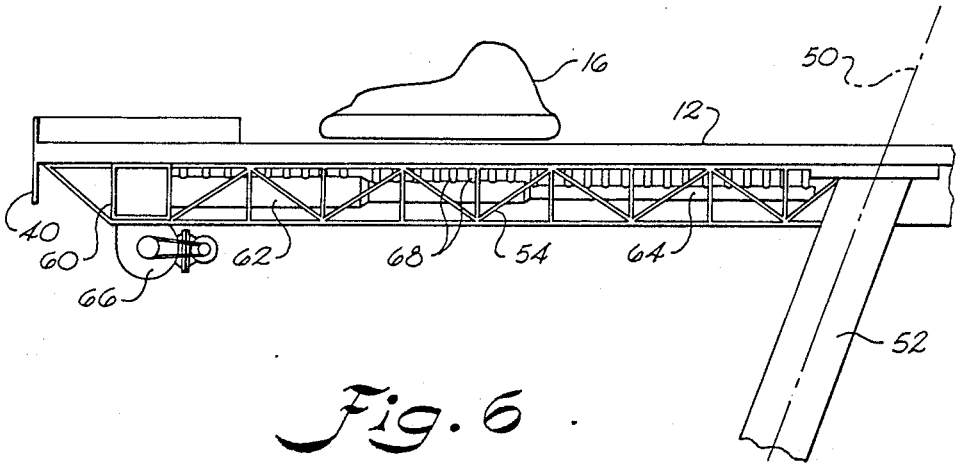
FIG. 6 is a cross-sectional view of a portion of the platform.

The motor drive system 34 produces rotation of the platform 12 relative to an axis of rotation indicated by the reference numeral 50, as shown in FIG. 6. The axis of rotation 50 is the longitudinal axis of a pillar 52 the angle of which, relative to the vertical, is equal to the angle that the operating plane for the platform 12 makes with the horizontal plane 22. The pillar 52 supports radially extending truss members 54 upon which the platform 12 is supported.

Figure 4:
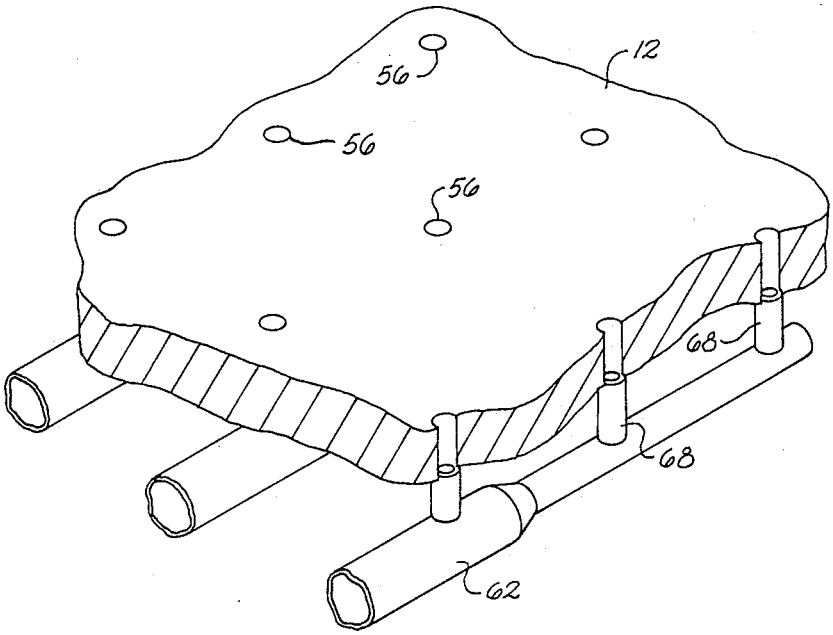
FIG. 4 is an isometric fragmentary view of a portion of the platform showing a fluid supply connection thereto.
Figure 5:
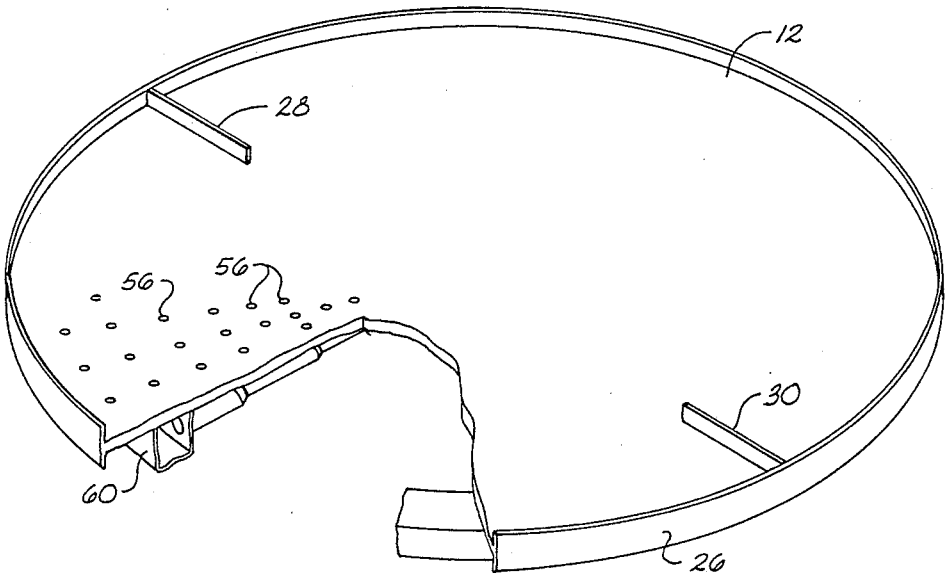
FIG. 5 is an isometric view of the platform.

The truss members 54 also support an air flotation system which is utilized in the present invention for supporting the cars 14 for movement relative to the platform 12. In FIGS. 4 and 5, the platform 12 is shown as being formed with a plurality of openings 56 which are generally arranged in a radial and circular pattern. The air flotation system also comprises a circular plenum 60 secured below the platform 12 and spaced inwardly along the rim 40.

Radially extending tubes 62 having sections of reduced diameter are secured at one end to the plenum 60 to be in communication therewith. Short sections of tubes 64 of lesser diameter are connected from the tubes 62 to each of the openings 56. A compressor and air pump system 66 mounted for movement with the platform 12 is supported adjacent the pillar 52. The system 66 serves to supply air under controlled pressure to the plenum 60, thence to the tubes 62 and finally to the individual tube sections 68. The diameters of the tubes in this pressurized air transport system is such that each of the openings 56 derives the same air flow at the same pressure.

In operation, with the platform rotating in the direction of the arrow 70 in FIG. 1, and with the cars 14 undergoing air flotation to reduce or eliminate the effect of friction relative to the airflow of the platform 12, one or more cars are brought to the upper side of the platform by their engagement with the railing 28. Upon nearing the topmost position of their travel, the cars being moved upwardly by the railing 28 gradually slide away from this railing to begin their random movement and rotation under the effect of gravity.

This random movement and rotation is produced by the combined effects of gravity, bumping from and striking other cars, and bumping the railing 26. If some minimal friction is allowed to remain between the cars and the platform 12, the cars will also experience rotational and revolving movements combined with the other effects.

As the railings 28 and 30 continue to bring the cars up to the top area of the platform, the cars are adapted to reach and ride equally upon the entire area of the platform thereby giving all passengers equal opportunity to the full enjoyment of the ride. The ride itself will comprise the repeated movement of the cars upwardly by the railings 28, 30 and the downward movement as described above until termination of the ride by the system operator.

Figure 7:
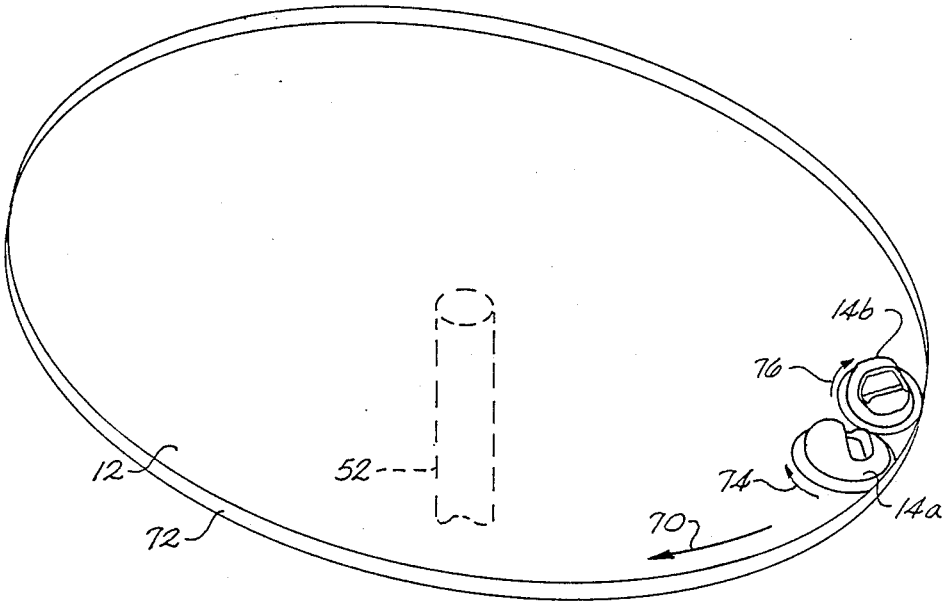
FIG. 7 is an isometric view of the riding platform in another arrangement of operation.

In another aspect of the invention, as shown in FIG. 7, the railing surrounding the disk 12, and indicated at 72, may be fixed to the circular edge of the walking deck 16, and the radial railings 28, 30 removed. With this arrangement, when a car 14*a* bumps against the railing 72 with the platform rotating in the direction of the arrow 70, the car 14*a* will rotate in the direction indicated by the arrow 74. However, the car 14*a* will remain immobile but will spin in accordance with the rotational speed of the moving platform.

When contacted by a second car 14*b*, which is also rotating due to its engagement with the railing 72 and therefore spinning in the direction of the arrow 76, the cars 14*a*, 14*b* become locked to each other and the railing 72 due to the opposite rotational direction of one of the cars to the other. This locked condition of the cars and the railing will move the cars upwardly along the railing until the cars fall off as they reach the top of the inclined platform. While only two cars have been discussed, it will be understood that the same conditions as described will occur when more than two cars contact each other and the railing when at the bottom of the platform. In this arrangement, the rails 28, 30 in the embodiment of FIG. 1 are not necessary as the cars 14 will be brought to the top of the amusement ride to commence their downward, random and unguided movement as before.

Figure 8:
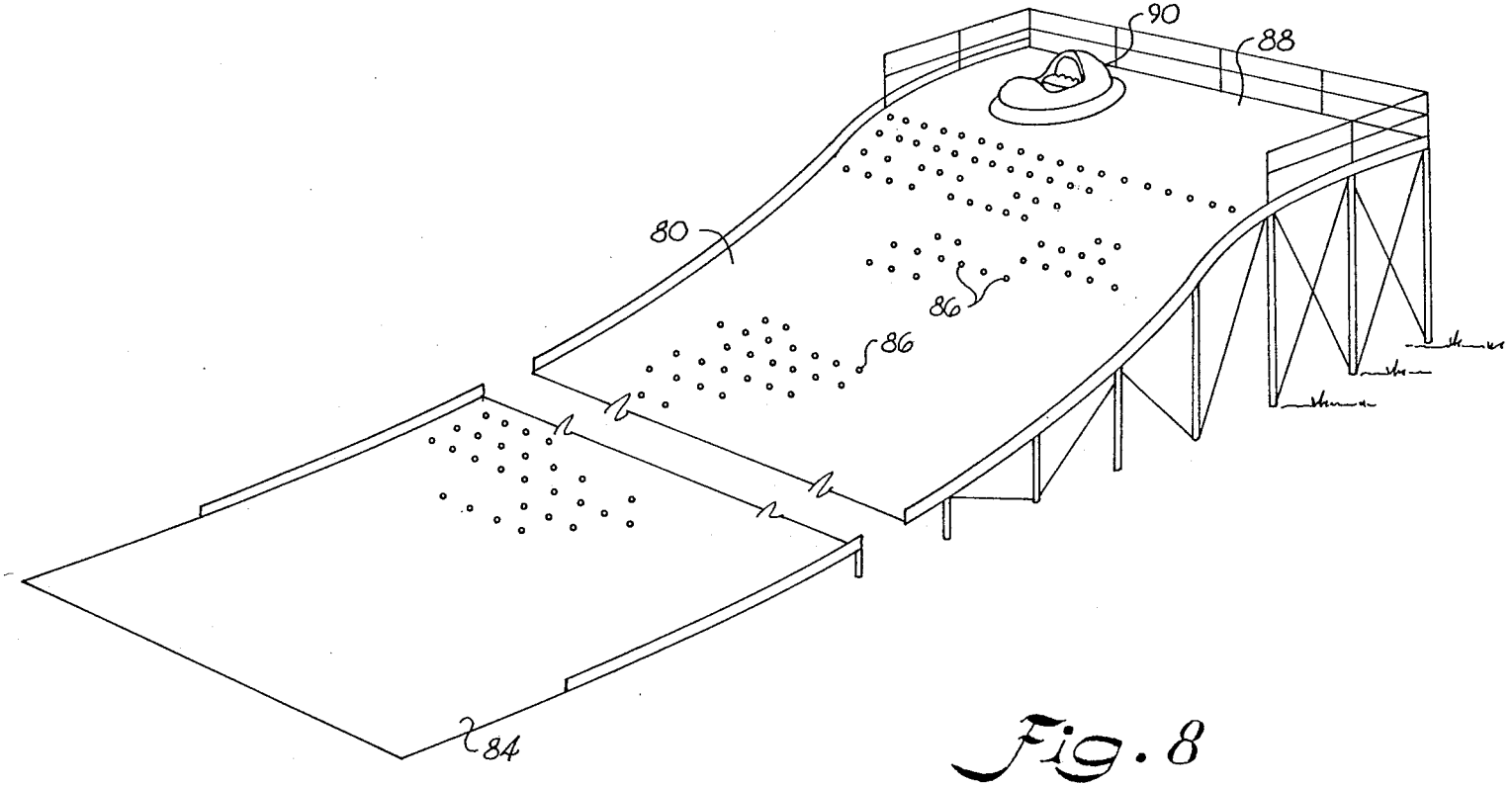
FIG. 8 is an isometric view of another embodiment of the invention.

In the embodiment of FIG. 8, the present invention is shown in its most basic form. In this arrangement, an inclined and fixed riding platform is shown being supported by suitable pillars 82. The platform is shown as slightly curved but may be flat except for the final terminal portion 84 whereat cars 14 will stop in their downward descent. The angle of the inclined platform to the horizontal plane is preferably 22°, but may be varied in accordance with the desired thrill of the ride.

As in the embodiment of FIG. 8, air flotation principles are utilized and to this end, the platform 80 is formed with a plurality of holes 86 and is associated with a blower/compressor system and piping network similar to that disclosed for the embodiment of FIG. 1. In this arrangement, however, the sizes of the holes diminish as they approach the terminal area 84 so that the speed of the cars will accordingly diminish toward the end of the ride. It is preferred that the sizes of the holes remain the same for the majority of the ride and start to diminish near the end of the ride. The terminal area 84 is free of the holes and further movement of the cars is halted in this area. While not shown, a suitable car lift mechanism may be utilized to bring cars up to the starting deck 88. In this embodiment, it is envisioned that the cars will be small and lightweight for individual occupants whereupon a car may be carried by the user by way of a stairway or personal elevator. It will be understood, however, that the cars may also be larger, appropriate for carrying more than one person, and a car-lift mechanism be added for the larger cars.

Figure 9:
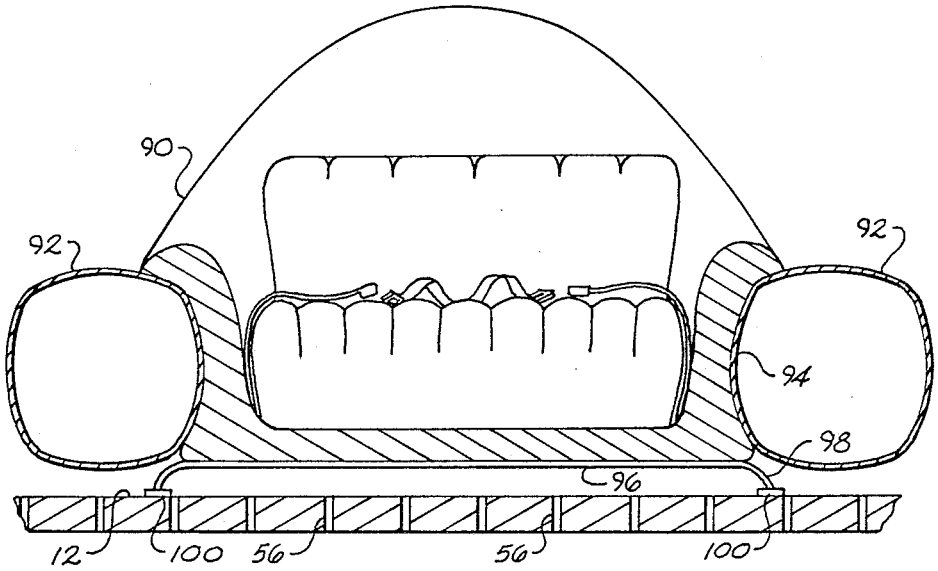
FIG. 9 is a partial cross-sectional view of a car adapted for use with the present invention.

A typical car 90 is shown in FIG. 9 as being suitable for both embodiments of FIGS. 1 and 7. The car, preferably made of fiberglass, includes an annular inflated urethane coated nylon tube 92 surrounding and held in a circular groove 94 formed around the car and held slightly above the surface of the platform 12, and an inverted saucer-shaped base 96 which cooperates with the holes 56 in the platform 12 to effect air flotation of the car. The base 96, also made of fiberglass, has its outer rim 98 coated with a thick layer 100 of a ultra-high molecular weight material to minimize wear of the rim and also provide some lubrication for the sliding movement of the car. With only the relatively narrow rim 98 being in operative engagement with the platform 12 and the base 96 being made of fiberglass, the base and rim have a degree of flexibility which compensates for any irregularity of the surface of the platform, thereby minimizing air losses during the presence of air flotation.

Figure 10:
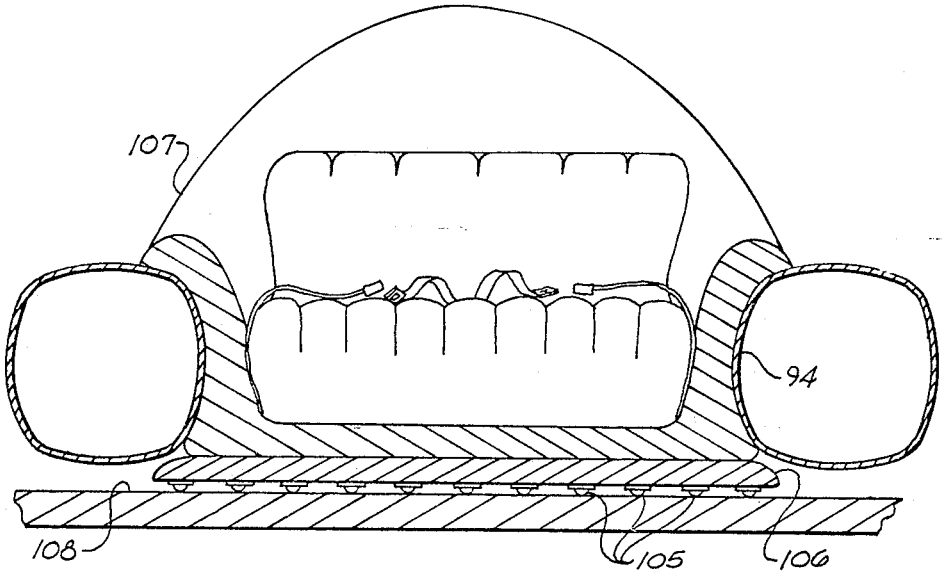
FIG. 10 is an elevational view of still another embodiment of the present invention utilizing ball wheels on each amusement car.
Figure 11:
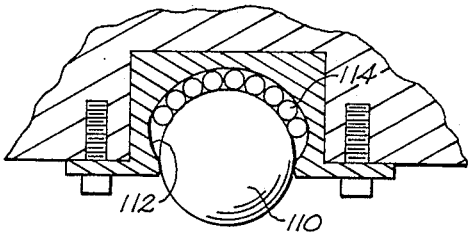
FIG. 11 is a cross-section of a detail of the embodiment of FIG. 10.

For the embodiment of FIGS. 10 and 11, air flotation is not utilized to provide free wheeling, random motion to the cars. In this embodiment, a plurality of roller ball devices 105 are mounted on the bottom support structure 106 of a car 107 and arranged to ride upon a ride platform 108. Each roller ball device comprises a free-rolling ball 110 held within a semi-spherical socket 112 and arranged to roll against small ball bearings 114 which lie against the inner surface of the socket. The roller balls 110 may be made from metal or plastic material depending upon the material of the ride platform 108, the acceptable noise level generated during a ride, or the weight of a car 107, or combinations of these factors. Except for the structure described above in relation to the air flotation features, the remaining structure may be utilized for the embodiment employing the roller ball devices. The ride platform 108 would not be formed with holes but may be rotating as in the embodiment of FIG. 1 or be fixed and inclined as in the embodiment of FIG. 8.

In using the embodiment of FIGS. 10 and 11 with a rotating platform as in FIG. 1, a ride would terminate when the platform 108 stops rotating and all of the cars 107 have assembled at the lower side of the platform. When used in the embodiment of FIG. 8, a reverse-incline area may be provided at the lower end of the ride platform to slow the cars which would then oscillate to a stop.

It will be appreciated that in both embodiments, FIGS. 1 and 10, utilizing air flotation or roller ball devices, respectively, means have been provided for substantially reducing the friction between an amusement car and a ride platform whereby the cars are adapted to experience free, random and rotative motion upon the application of a relatively small force and/or by a slight inclination of the platform. The small force can be generated as a result of the impact of the car with other cars, or a railing or a bumper placed on the platform.

From the foregoing, it will be appreciated that the present invention enables the enjoyment of an amusement ride comprising free, random movements which all passengers will be able to experience equally regardless of skill and agility. It will also be appreciated that the structure for the amusement ride comprises simple and inexpensive parts and occupies minimal space for operation.

While the invention has been disclosed with reference to the structure disclosed, it is not confined to the details set forth but is intended to cover such modifications or changes as may come within the scope of the following claims.

What is claimed is:

1. An amusement ride system comprising
a rotatable platform positioned in an operating plane at an angle to the horizontal plane,
means for rotating said platform in said operating plane,
said platform being formed with a plurality of openings to permit the passage of pressurized fluid therethrough,
a plurality of amusement cars adapted for freely resting upon said platform, and
means for directing pressurized fluid to said openings from below said operating plane to reduce the frictional engagement of said cars relative to said platform sufficiently to permit free, random movement of said cars from the higher side of said platform to the lower side thereof during rotation of the same.

2. The amusement ride system as defined in claim 1 including a circular car bumper railing surrounding said platform against which said cars bump during rotation of said platform.

3. The amusement ride system as defined in claim 1 including means for directing one or more cars toward said higher side of said platform.

4. The amusement ride system as defined in claim 1 including a fixed circular car bumper railing surrounding said platform against which two or more cars bump to cause opposite rotation thereof and self-locking when in contact thereby effecting movement of the cars toward said higher side.

5. An amusement ride mechanism comprising an air flotation system having a rotatable platform arranged at an angle to define an upper side and a lower side,
at least one amusement car adapted for freely resting upon said platform under the influence of the air flotation system and
means for moving said car to said upper side to permit free movement of the same car from the upper side of said platform to the lower side thereof during rotation of said platform.

6. The amusement ride system as defined in claim 5 including a circular car bumper railing surrounding said platform against which said cars bump during rotation of said platform.

7. The amusement ride system as defined in claim 6 wherein said means for moving said car is a car bumping railing movable with said platform.

8. An amusement ride mechanism comprising an air flotation system having a platform arranged at an angle relative to the horizontal plane to define an upper side and a lower side,
at least one amusement car adapted for freely riding upon said platform under the influence of the air flotation system,
said car being adapted for free movement from the upper end of said platform to the lower side thereof during the presence of air flotation pressure relative to said platform.

9. The amusement ride system as defined in claim 8 wherein said air flotation system includes holes in said platform which diminish in size as the holes approach said lower side thereby serving to slow the car as the same approaches said lower side.

10. An amusement ride mechanism comprising a ride platform arranged at an angle relative to the horizontal plane to define an upper side and a lower side,
at least one amusement car adapted for resting upon said platform,
means operatively associated with said at least one amusement car for permitting the free and unguided motion upon inclination of said platform,
said car being adapted for free and unguided movement from the upper end of said platform to the lower side thereof resulting from said inclination.

11. The amusement ride system as defined in claim 10 wherein said platform is rotatable.

12. The amusement ride system as defined in claim 11 including a circular car bumper railing surrounding said platform against which said cars bump during rotation of said platform.

13. The amusement ride system as defined in claim 11 including means for directing one or more cars toward said higher side of said platform.

14. The amusement ride system as defined in claim 10 wherein said platform is fixed and inclined relative to the horizontal plane.

15. The amusement ride system as defined in claim 10 wherein said operatively associated means is a plurality of roller ball devices mounted on said at least one amusement car and adapted to support said car upon said ride platform.

16. The amusement ride system as defined in claim 15 wherein said platform is rotatable.

17. The amusement ride system as defined in claim 15 including means for directing one or more cars toward said higher side of said platform.

18. The amusement ride system as defined in claim 17 including at least one car bumper railing being arranged radially from said circular railing and being rotatably movable with said platform for moving one or more cars from one side of the platform to the other.

19. The amusement ride system as defined in claim 15 including a fixed circular car bumper railing surrounding said platform against which two or more cars bump to cause opposite rotation thereof and self-locking when in contact thereby effecting movement of the cars toward said higher side.

20. An amusement ride system comprising
a rotatable platform positioned in an operating plane at an angle to the horizontal plane,
means for rotating said platform in said operating plane,
said platform being formed with a plurality of openings to permit the passage of pressurized fluid therethrough,
a plurality of amusement cars adapted for freely resting upon said platform,
means for directing pressurized fluid to said openings from below said operating plane to reduce the frictional engagement of said cars relative to said platform sufficiently to permit free movement of said cars from the higher side of said platform to the lower side thereof during rotation of the same,
a circular car bumber railing surrounding said platform against which said cars bump during rotation of said platform, and
at least one car bumper railing being arranged radially from said circular railing and being rotatably moveable with said platform for moving one or more cars from one side of the platform to the other.

21. An amusement ride mechanism comprising a ride platform arranged at an angle relative to the horizontal plane to define an upper side and a lower side, at least one amusement car adapted for resting upon said platform, means operatively associated with said at least one amusement car for permitting the free motion upon inclination of said platform, said car being adapted for free movement from the upper end of said platform to the lower side thereof resulting from said inclination, said system having an air flotation system including holes formed in said platform, and means for directing pressurized fluid to said openings from below said operating plane to reduce the frictional engagement of said cars relative to said platform sufficiently to permit free movement of said cars from the higher side of said platform to the lower side thereof.

22. An amusement ride mechanism comprising a rotatable ride platform arranged at an angle relative to the horizontal plane to define an upper side and a lower side, at least one amusement car adapted for resting upon said platform, means operatively associated with said at least one amusement car for permitting the free motion upon inclination of said platform, said car being adapted for free movement from the upper end of said platform to the lower side thereof resulting from said inclination, said system including at least one car bumper railing being arranged radially from said circular railing and being rotatably movable with said platform for moving one or more cars from one side of the platform to the other.

* * * * *